US010246108B2

(12) United States Patent
Nikolaus et al.

(10) Patent No.: US 10,246,108 B2
(45) Date of Patent: Apr. 2, 2019

(54) LINKAGE FOR CONNECTING A RAILCAR BODY-SIDE END REGION OF A COUPLING ROD IN AN ARTICULATED MANNER TO A RAILCAR BODY

(71) Applicant: Voith Patent GmbH, Heidenheim (DE)

(72) Inventors: Christoph Nikolaus, Cremlingen (DE); Arthur Kontetzki, Salzgitter (DE); Kay Uwe Kolshorn, Wolfenbuettel (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 15/798,152

(22) Filed: Oct. 30, 2017

(65) Prior Publication Data

US 2018/0050709 A1 Feb. 22, 2018

Related U.S. Application Data

(63) Continuation of application No. PCT/EP2016/059483, filed on Apr. 28, 2016.

(30) Foreign Application Priority Data

Apr. 29, 2015 (DE) ..... 10 2015 207 907

(51) Int. Cl.
*B61G 1/10* (2006.01)
*B61G 7/10* (2006.01)
(Continued)

(52) U.S. Cl.
CPC ..... *B61G 1/10* (2013.01); *B61G 1/32* (2013.01); *B61G 1/40* (2013.01); *B61G 7/10* (2013.01); *B61G 9/24* (2013.01)

(58) Field of Classification Search
CPC ... B61G 1/10; B61G 1/32; B61G 1/40; B61G 5/02; B61G 7/10; B61G 9/06; B61G 9/24
(Continued)

(56) References Cited

U.S. PATENT DOCUMENTS 8,328,030 B2 12/2012 Kontetzki
8,714,376 B2 * 5/2014 Bartel ..... B61G 5/02 213/40 R
(Continued)

FOREIGN PATENT DOCUMENTS

CN 101219669 A 7/2008
DE 29609088 U1 10/1997
(Continued)

OTHER PUBLICATIONS

International Search Report of the international searching authority dated Jul. 28, 2016 in international patent application PCT/EP2016/059483 on which the claim of priority is based.
(Continued)

*Primary Examiner* — Zachary L Kuhfuss
(74) *Attorney, Agent, or Firm* — Walter Ottesen, P.A.

(57) ABSTRACT

A linkage articulatedly connects a railcar end portion of a coupling rod to a railcar body. A longitudinal axis of the coupling rod, in the neutral position, coincides with the longitudinal direction of the rail-borne vehicle. The linkage includes a base plate coupled via a bearing to the railcar body. The base plate has a through opening for the coupling rod extending therethrough. A pull/push assembly includes a first supporting element arranged between the base plate and the railcar body and a second supporting element on the side of the base plate facing away from the railcar body. First and second spring units are disposed between the base plate and corresponding ones of the supporting elements. The base plate is mounted in the bearing block to pivot in a horizontal plane transversely with respect to the longitudinal direction.

20 Claims, 4 Drawing Sheets

(51) Int. Cl.
*B61G 9/24* (2006.01)
*B61G 1/32* (2006.01)
*B61G 1/40* (2006.01)

(58) Field of Classification Search
USPC ..... 213/46 A
See application file for complete search history.

(56) References Cited

U.S. PATENT DOCUMENTS

| | | | | |
|---|---|---|---|---|
| 2015/0008208 | A1* | 1/2015 | Liu | B61G 7/14 213/221 |
| 2017/0225696 | A1* | 8/2017 | Westman | B61G 7/00 |
| 2017/0232980 | A1* | 8/2017 | Schmidt | B61G 11/16 213/53 |

FOREIGN PATENT DOCUMENTS

| | | | | | |
|---|---|---|---|---|---|
| DE | 10210059 | C1 | * | 10/2003 | B61G 7/10 |
| DE | 10246428 | A1 | | 4/2004 | |
| DE | 102005034527 | A1 | * | 1/2007 | B61G 7/10 |
| DE | 102005033849 | B4 | * | 9/2008 | B61G 7/10 |
| DE | 102008008214 | A1 | | 9/2008 | |
| DE | 10246428 | B4 | * | 7/2009 | B61G 7/10 |
| EP | 1247715 | A1 | | 10/2002 | |
| EP | 1342637 | A1 | | 9/2003 | |
| EP | 1407954 | A1 | * | 4/2004 | B61G 7/10 |
| EP | 1747960 | A2 | * | 1/2007 | B61G 7/10 |
| EP | 1925523 | A1 | | 5/2008 | |
| EP | 1995146 | A1 | * | 11/2008 | B61G 7/10 |
| GB | 1215810 | A | | 12/1970 | |

OTHER PUBLICATIONS

English translation and Chinese Office action dated Aug. 3, 2018 of corresponding Chinese application No. 201680023110.7.

* cited by examiner

LINKAGE FOR CONNECTING A RAILCAR BODY-SIDE END REGION OF A COUPLING ROD IN AN ARTICULATED MANNER TO A RAILCAR BODY

CROSS REFERENCE TO RELATED APPLICATIONS

This application is a continuation application of international patent application PCT/EP2016/059483, filed Apr. 28, 2016 designating the United States and claiming priority from German application 10 2015 207 907.4, filed Apr. 29, 2015, and the entire content of both applications is incorporated herein by reference.

FIELD OF THE INVENTION

The invention relates to a linkage for connecting a railcar body-side end region of a coupling rod in an articulated manner to a railcar body of a rail-borne vehicle, a longitudinal axis of the coupling rod coinciding in the neutral position with the longitudinal direction of the rail vehicle, and the linkage having the following:

- a base plate which is coupled via a bearing block which can be connected in a stationary manner to the railcar body, in which base plate a through opening is configured, through which a railcar body-side end region of the coupling rod is guided in an extending manner, and
- a pull/push device which is arranged in the railcar body-side end region of the coupling rod, with a coupling-side supporting element and a railcar body-side supporting element arranged between the base plate and the railcar body, spring units being arranged in each case between the base plate and the respective railcar body-side and coupling head-side supporting elements.

BACKGROUND OF THE INVENTION

Linkages of this type are previously known in a very wide variety of embodiments from the prior art. Reference is made representatively here to the following documents:

EP 1 925 523 A

DE 102 46 428 B4

GB 1215810A

U.S. Pat. No. 8,328,030

A linkage of the generic type is described, for example, in U.S. Pat. No. 8,328,030.

The linkages, which are disclosed in the documents and in which energy absorption devices are integrated, assume a pull/push securing function, since the energy absorption device can receive (absorb) the pulling and pushing forces which are transmitted from the coupling rod to the bearing block up to a defined magnitude, with the result that the forces are forwarded in an attenuated manner via the bearing block to the vehicle chassis. The energy absorption device is provided as a rule for absorbing pulling and pushing forces which occur during normal travelling and coupling operation, for example, between the individual railcar bodies of a multiple-member vehicle combination. Here, the spherical bearing is as a rule what is known as a spherolastic bearing which absorbs the longitudinal, transverse and vertical forces which occur between the adjoining railcar bodies during traveling of the multiple-member vehicle.

Here, the structural configuration, in particular of the energy absorption elements in the form of the spring units and the connector elements, determines the possible deflection angles, as a result of which the configuration is in part greatly restricted.

SUMMARY OF THE INVENTION

It is an object of the invention to provide a linkage of the type mentioned hereinabove, in such a way that the linkage firstly reliably supports deflection angles of different magnitude in the individual deflection directions and secondly compressive forces which act in a straight line and forces which act at an angle. Here, the solution according to the invention is distinguished by a low number of components and a compact overall configuration.

A linkage according to the invention is for connecting a railcar body-side end region of a coupling rod in an articulated manner to a railcar body of a rail-borne vehicle, a longitudinal axis of the coupling rod coinciding in the neutral position with the longitudinal direction of the rail vehicle, and the linkage has the following:

- a base plate which is coupled via a bearing block which can be connected in a stationary manner to the railcar body, in which base plate a through opening is configured, through which a railcar body-side end region of the coupling rod is guided in an extending manner, and
- a pull/push device which is arranged in the railcar body-side end region of the coupling rod, with a coupling-side supporting element and a railcar body-side supporting element arranged between the base plate and the railcar body, spring units being arranged in each case between the base plate and the respective railcar body-side and coupling head-side supporting elements, is distinguished according to a first basic embodiment by the fact that the base plate is mounted in the bearing block such that it can be pivoted in a horizontal plane transversely with respect to the longitudinal direction, and the coupling rod is mounted in the through opening via a ball and socket bearing. In other words, the base plate can be pivoted about an axis vertically with respect to the longitudinal direction, in particular an axis which is oriented vertically with respect to the coupling longitudinal axis in the neutral position.

According to a second basic embodiment, a solution according to the invention is distinguished by the fact that the coupling rod is mounted on the railcar body via a ball and socket bearing, a first element of the ball and socket bearing being formed by the bearing block or an element which is connected to the latter, and a second element of the ball and socket bearing being formed by the base plate, and the base plate being connected to the railcar body-side end region of the coupling rod.

The neutral position corresponds to the position of the coupling rod in the installed position in the unloaded state on a rail-borne vehicle with respect to the latter. In the neutral position, a longitudinal axis of the coupling rod is oriented in the longitudinal direction of the rail-borne vehicle. A deflection out of the neutral position takes place under load.

The two basic embodiments are distinguished by the integration of a ball and socket bearing for articulation on the railcar body of a rail-borne vehicle, the function of the ball and socket bearing having been moved in both cases directly into the connection to the bearing block or the railcar body, as a result of which great deflection angles of the coupling rod about the neutral position are possible. Whereas the functions of the deflection for different angular ranges in the different directions are assigned to different components in the first basic embodiment, the task is assigned solely to the ball and socket bearing which realizes the connection to the railcar body in the second basic embodiment, with a concentration of functions.

In one configuration according to the first basic embodiment, the outer circumferential region of the through opening of the base plate or an element which is non-positively or positively connected to the latter forms a ball socket of the ball and socket bearing with a spherical cap-like bearing face for a ball joint. The ball joint has a through opening for receiving the railcar body-side end region of the coupling rod. The rotatable articulation of the base plate on the bearing block permits an increased rotational range in the horizontal plane via the ball and socket bearing, independently of the possible deflection angle. Therefore, the individual components can be optimized with regard to the deflection angles which are required in the respective directions.

In this configuration, a plain bearing, in particular a radial plain or slide bearing, can be provided between the ball joint and the coupling rod, the positional allocation of the coupling rod and the base plate in the axial direction not being tightly fixed. Another variant of the configuration is distinguished by the fact that the coupling rod is connected to the ball joint in a positively locking or non-positive manner, as a result of which there is a fixed positional allocation between the coupling rod and the base plate.

The bearing block can be configured in a wide variety of configurations. It has two receiving openings, the center axes of which are configured in the installed position so as to run perpendicularly with respect to the longitudinal direction of the coupling rod in the neutral position, the base plate being mounted in one of the receiving openings via at least in each case one rotary joint. The function of the rotary joint can be realized via a rotary pin. In one particularly advantageous configuration, the bearing block has two receiving openings which can be closed via a bearing cap, the center axis of which receiving openings is configured so as to run perpendicularly with respect to the longitudinal direction of the coupling rod in the neutral position. The base plate is connected to the bearing cap in a non-positive or positively locking manner, and the bearing cap is mounted rotatably in the receiving opening. The embodiment provides a rotationally articulated connection between the base plate and the bearing block, which connection is simple to realize and is functional.

The second basic embodiment affords the advantage of a high concentration of functions with a low number of components and a compact overall configuration, the compressive forces and tensile forces being transmitted reliably to the bearing block in the neutral position and also in the case of an introduction of force at an angle.

In one particularly advantageous embodiment, it is provided in the two basic embodiments that the spring unit which is provided between the coupling-side supporting element and the base plate, preferably also between the railcar body-side supporting element and the base plate, comprises a plurality of spring elements which are arranged in series with respect to one another, the individual spring elements being coupled to one another via intermediate elements with the configuration of the units, as a result of which recourse can be made to standardized spring elements in order to configure spring units of different dimensions.

In one particularly advantageous embodiment of the two basic embodiments, they are configured with a device for preventing vertical lift, in particular a vertical lift protective means. To this end, on its end face which points toward the coupling-side supporting element, the bearing block has bearing face regions which are arranged at a spacing from bearing face regions on the coupling-side supporting element in the neutral position and pass into contact in the case of a deflection in the horizontal and/or vertical direction with a provided movement of the coupling rod out of the neutral position, and preferably enter into a non-positive and/or positively locking connection.

The advantages which can be achieved by way of the solution according to the invention are obvious: in particular, a stabilizing effect, in particular in the vertical direction, can be brought about by way of the provision of the respective bearing face regions on the bearing block on one side and on the coupling rod, in particular the supporting plate on the other side, which enter into an operative connection with one another after the maximum longitudinal displacement travel of the pull/push device which is integrated into the joint arrangement is exhausted, which are formed in one particularly advantageous configuration by a non-positive and/or positively locking connection, as a result of which the anti-derailment security of the railcar body is increased. Since the bearing faces which are assigned to the respective stops are arranged in each case above and below the horizontal coupling plane, a restoring moment is applied to the coupling rod after the maximum longitudinal displacement travel of the spring units is exhausted, which restoring moment counteracts a possibly provided vertical deflection of the coupling rod out of the neutral position.

In a further advantageous embodiment, in order to reduce the restoring moments which are produced and the associated bending moments which act on the coupling rod, the two contact points (in the case of contact) between the supporting element and the bearing block are no longer configured as rigid stops, but rather in an elastic manner, in particular as spring elements (for example, leaf springs). The movement capability of the coupling rod in the longitudinal direction is increased once more by way of the compression of the spring elements in the longitudinal direction. A greater proportion of the longitudinal force is thus produced via the additional compression of the elastomer elements, and not at the contact point. This leads to lower bending moments in the coupling rod, since the force vectors in total are at a smaller spacing from the center line of the coupling rod.

BRIEF DESCRIPTION OF THE DRAWINGS

The invention will now be described with reference to the drawings wherein.

DESCRIPTION OF THE PREFERRED EMBODIMENTS OF THE INVENTION

Figure 1A:
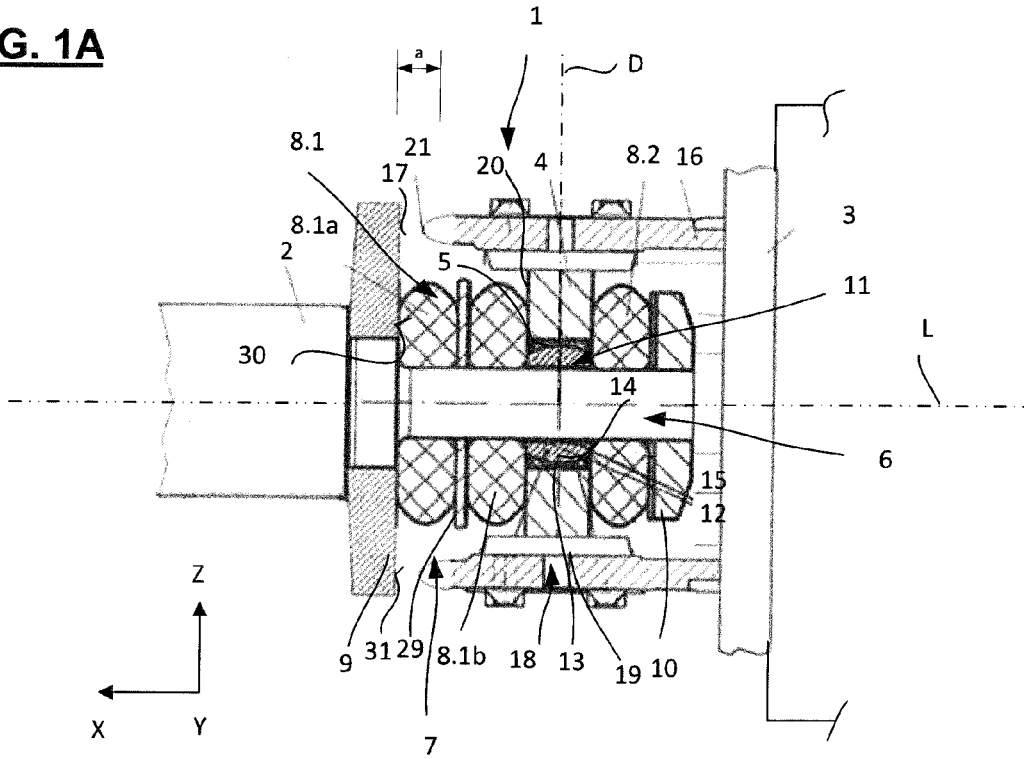
FIG. 1A shows a diagrammatically simplified schematic of an axial section of the basic construction of a linkage according to the invention in accordance with a first embodiment in the neutral position.
Figure 1B:
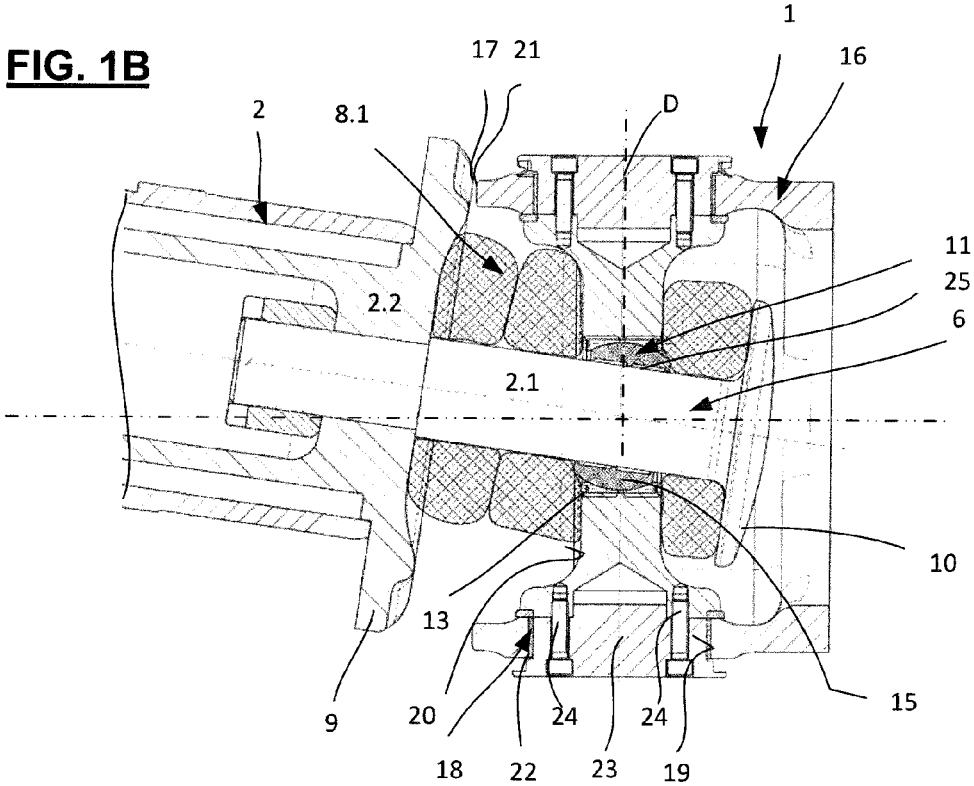
FIG. 1B shows by way of example an axial section of the basic construction of a linkage according to the invention in accordance with a first embodiment in a deflected position.

FIG. 1A shows a diagrammatically simplified schematic of the basic construction of a linkage 1 according to the invention for connecting a coupling rod 2 in an articulated manner to a railcar body 3 (indicated diagrammatically) in accordance with a first embodiment in a first functional position, what is known as the neutral position, whereas FIG. 1B shows, by way of example, a structural embodiment in a second functional position, a deflected position, with a deflection here in the vertical direction with respect to the longitudinal direction.

In the first functional position, the linkage is free from a deflection out of its neutral position. In this functional state, the coupling rod 2 is oriented with its longitudinal axis L in the longitudinal direction of the rail vehicle. A coordinate system is used by way of example in order to show the individual directions. Here, the X-direction describes the extent in the longitudinal direction which coincides with the direction of extent of the longitudinal axis L of the coupling rod 2 in the non-deflected state, that is, the first functional position. The Y-direction describes the direction transversely with respect to the X-direction. In the installed position of the coupling rod 2 on a rail vehicle, this corresponds to the transverse direction, whereas the Z-direction describes the vertical direction.

The linkage 1 comprises a base plate 4 which can be connected to a railcar body and in which a through opening 5 is configured, through which a railcar body-side end region 6 of the coupling rod 2 extends. Furthermore, the linkage comprises a pull/push device 7 which is arranged on the railcar body-side end region 6 of the coupling rod 2. That end region (not shown here) of the coupling rod 2 which lies opposite the railcar body-side end region 6 of the coupling rod 2 is coupled, for example, to a coupling head of a center buffer coupler (not shown here) and is called a coupling-side end region. Here, the pull/push device 7 comprises spring units 8, in particular 8.1, 8.2, which are arranged on both sides of the base plate 4 and are supported on supporting elements, in particular supporting plates, 9 and 10 which are coupled at least indirectly to the coupling rod 2. Here, the term "plate" is to be understood in a purely functional manner. These are functional elements which form at least one supporting face and preferably have a smaller width in the longitudinal direction than the extent in the vertical or transverse direction. The geometric configuration, in particular contour, is preferably selected to be rectangular or circular. Here, the spring unit 8.1 is active, in the neutral position, in the compression direction of the coupling rod 2 in the direction (parallel to/along the longitudinal axis or with a direction component parallel to/along the longitudinal axis L) of the longitudinal axis L of the coupling which is connected to the coupling rod 2, in the direction of the railcar body; whereas, the second spring unit 8.2 is active in the pulling direction of the coupling rod 2, in the direction (parallel to/along the longitudinal axis or with a direction component parallel to/along the longitudinal axis L) of the longitudinal axis L of the coupling which is connected to the coupling rod 2.

Here, the supporting plate, which is arranged on the railcar body side, is denoted by 10 and is connected fixedly to the end region 6 of the coupling rod 2 so as to rotate therewith, that is, so as to be driven therewith. The connection is of non-positive or positively locking configuration. An integral configuration is also conceivable, the coupling rod 2 preferably being of multiple piece configuration in this case, and the supporting plate 10 then being configured in one piece with a part region of the coupling rod 2. In the installed position, as viewed in the longitudinal direction, the supporting plate 10 is arranged between the base plate 4 and the railcar body. As viewed in the longitudinal direction of the coupling rod 2, the supporting plate 9 is arranged in front of the base plate 4 as viewed in the direction of the railcar body 3. The supporting plate 9 is at least indirectly connected fixedly to the coupling rod 2 so as to rotate therewith, that is, depending on the configuration, is either configured integrally with the latter or else is connected to the latter in a positively locking or non-positive or integrally joined manner, or a combination thereof. The front spring unit, in particular an elastomer spring unit 8.1, is provided between the base plate 4 and the supporting element which is arranged in front of the base plate 4 in the longitudinal direction in the form of a supporting plate 9. In the case which is shown, the spring unit comprises a plurality of, preferably two or more, elastic elements, in particular spring elements 8.1*a*, 8.1*b*, which are arranged in series next to one another in the longitudinal direction and either make contact directly with one another or can be supported against one another via intermediate elements 29, as shown in FIG. 1A.

A rear spring unit 8.2 which is active, in particular, in the case of a pulling force is provided between the base plate 4 and the supporting plate 10 which is arranged on the railcar body side. In the case which is shown, the spring unit 8.2 comprises, for example, only one elastomer spring element.

The guidance of the railcar body-side end region 6 of the coupling rod 2 through the base plate 4 takes place via a spherical bearing, in particular a ball and socket bearing 11. In the simplest case, this is configured as a ball joint, comprising a shaped-out formation which is provided in the through opening 5 of the base plate 4, forms a ball socket 12 with a spherical cap-like bearing face 14, and interacts with the circumferential face of a ball joint 15. The shaped-out formation can be configured directly on the base plate 4 or else on a receiving device 13 which can be connected to the latter or can be inserted into the through opening 5. The ball joint 15 has a through opening 25 for receiving or guiding through the railcar body-side end region 6 of the coupling rod 2. Here, the center axis is arranged concentrically with respect to the center axis of the through opening 5 in the installed position.

The base plate 4 is attached on the railcar body in an articulated manner. The articulated connection takes place via a bearing block 16 which is fixedly mounted on the railcar body 3. The articulation of the base plate 4 on the bearing block 16 takes place via at least one rotary joint 18 which is connected to the bearing block 16, preferably extends into an opening 19 on the bearing block, and is coupled to the base plate 4. Here, the rotational axis of the rotary joint is oriented in the vertical direction with respect to the longitudinal axis L of the coupling rod 2 and therefore perpendicularly. The rotational axis is denoted by D.

The attachment of the base plate 4 on the bearing block 16 takes place in a stationary manner as viewed in the longitudinal direction of the longitudinal axis L, but pivotably in the transverse direction with respect to the longitudinal axis L, that is, in a horizontal plane. To this end, in the simplest case, the base plate 4 can be attached, on its peripheral faces, which are provided spaced apart in the vertical direction from the longitudinal axis L, to the bearing block 16 via a rotary joint 18 in the form of a rotary pin, in particular can be mounted in a receiving opening 19 which is provided for this purpose on the bearing block 16, such that it can be rotated about a center axis of the receiving opening 19. Here, the center axis of the receiving opening 19 coincides with the rotational axis D. In the embodiment shown, the bearing block 16 has two bearing regions which are arranged spaced apart from one another perpendicularly with respect to the longitudinal direction in the installed position, and in which the base plate 4 is mounted rotatably on both sides as viewed in each embodiment in the vertical direction.

The geometric configuration of the individual plates, the base plate 4 and the supporting plates 9 and 10, preferably takes place with a substantially square or rectangular cross-sectional area. The cross-sectional area of the individual spring elements 8.1*a*, 8.1*b* and 8.2 is configured in an analogous manner to this. Here, the individual spring units 8.1 and 8.2 which are arranged on respective sides of the base plate 4 are preferably configured as independent separate structural units. They can comprise in each case one or more spring elements. Spring units 8.1, which comprise two or more spring elements, are preferably arranged between the base plate 4 and the supporting plate 9 which is arranged on the end region which is directed away from the railcar body-side end region 6. The deflection angle in the vertical direction and/or in the horizontal direction out of the neutral position, which corresponds to the longitudinal direction (shown in FIG. 1A) of the longitudinal axis L, is given as a function of the elasticity of the spring elements of the individual spring units 8.1 and 8.2. In the embodiment shown, the maximum deflection is represented by the elasticity of the spring unit 8.2 and the resulting, theoretically possible deformation travel.

Here, the spring unit 8.1 comprises two spring elements 8.1*a* and 8.1*b* which, in the unloaded state, bridge a spacing between the base plate 4 and the supporting plate 9 with prestress or free from prestress. The spring unit 8.1 is supported on one side on the base plate 4 and on the other side on the supporting plate 9. In detail, the spring element 8.1*b* is supported here on a surface region on that end face 20 of the base plate 4 which is directed away from the railcar body 3, and the spring element 8.1*a* is supported on the end face 17 on the supporting plate 9 on a surface region 30 which is directed toward the railcar body 3. Here, that end face 17 of the supporting plate 9, which is directed toward the railcar body 3, is spaced apart from the base plate 4 and, furthermore, is configured on the bearing regions of the bearing block 16, which are arranged on both sides of the longitudinal axis L, at a spacing a from the end faces 21, which are directed away from the railcar body 3, in the installed position in the unloaded state, as viewed in the longitudinal direction of the coupling rod 2. Upward lift protection means is realized via the surface regions which face one another on the end faces 21 on the bearing block 16 and on the end face 17 of the supporting plate 9, that is, the maximum deflection is limited and undesired buckling in the vertical direction is avoided, by the forces being supported via the surface regions 21, 31, which can then be brought into operative connection with one another, of the bearing block 16 and of the end face 17 of the supporting plate, respectively.

The surface regions 30 and 31 are arranged offset from one another in the vertical direction, the surface region 31 being arranged, starting from the longitudinal axis L, at a greater spacing from the latter than the surface region 30.

In one advantageous embodiment (not shown in detail here, however), at least the individual surface region 21 on the bearing block 16 and preferably also the individual surface region 31 on the supporting plate 9 are of curved configuration in a view from above, with the result that, in the case of deflection, during pivoting in the horizontal direction, there is no tilting and therefore punctiform contact, but rather at least linear or full surface contact.

The embodiment (shown in FIG. 1A) in the neutral position is reproduced in FIG. 1B for one advantageous structural embodiment in the deflected position. Here, the interaction of the individual surface regions 21 and 31 with one another can be seen.

In FIG. 1B, the base plate 4 with the bearing block 16 is connected on both sides of the longitudinal axis L in each case to a bearing cap 23 via fastening elements 24, in the form of screw connection elements here. Here, the individual bearing cap 23 closes the opening 19 and has a first part which is supported on a surface region on the outer circumference of the bearing block 16, and a part which extends into the opening 19 on the bearing block 16. For attachment purposes, in the case which is shown, the base plate 4 has a substantially X-shaped cross section; different embodiments are conceivable. The configuration of the through opening 5 and of the ball and socket bearing 11 corresponds to that described in FIG. 1A. The rotary joint connection between the base plate 4 and the bearing block 16 is realized via a bush 22 which is arranged between the opening 19 and the bearing cap 23 and permits a relative movement at least over a part range between the bearing cap 23 and the base plate 4 which is connected thereto and the bearing block 16.

The embodiment according to FIGS. 1A and 1B is distinguished by the fact that a deflection is realized, in relation to the installed position, perpendicularly, in particular vertically or at least with a direction component perpendicularly, in particular vertically with respect to the longitudinal direction of the rail vehicle via the ball and socket bearing 11, it being possible for the deflection in the horizontal plane, in particular with a direction component out of the position of the longitudinal axis in the neutral position transversely with respect to it, to also be increased via the rotary joint 18, that is, for the pivoting of the base plate 4 about a perpendicular with respect to the longitudinal axis to be increased. The embodiment is suitable for compensating for both tensile and compressive forces. The contact via the surface regions 21 and 31 on the bearing block 16 and the supporting plate 9 which can be brought into operative connection with one another makes direct supporting of the forces possible, and the introduction into the railcar body 3 free from undesired diving of the coupling rod and releasing of the latter from the bearing block 16 by way of the deflection of force directly via the supporting plate 9 onto the bearing block 16.

FIG. 1B shows a functional position with a deflection in the vertical direction in the case of compressive loading. The resulting deformation of the spring units 8.1 and 8.2 can be seen, which spring units 8.1 and 8.2 take over supporting of the forces until the surface region 31 (arranged above the longitudinal axis in this view) of the supporting plate 9 comes into contact with the bearing block 16.

Figure 1C:
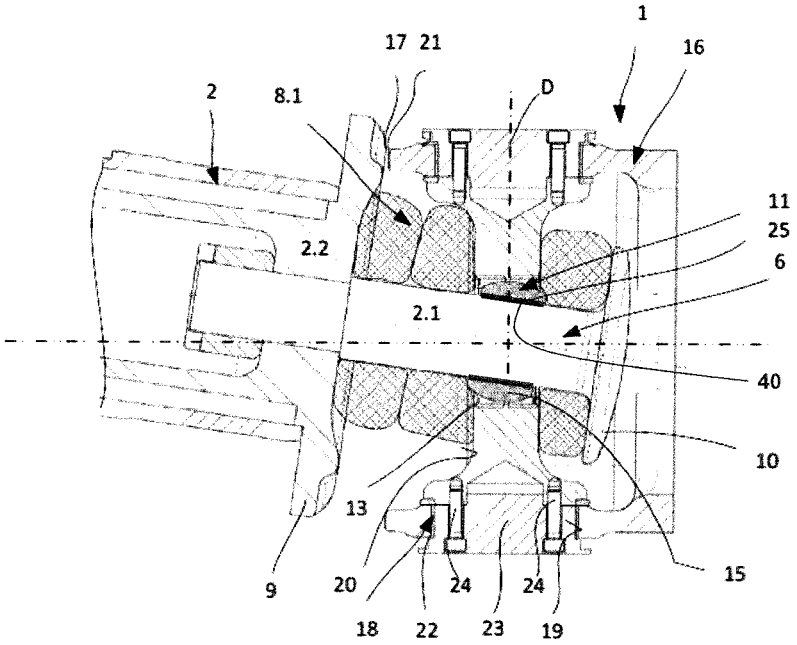
FIG. 1C is a schematic showing the embodiment of FIGS. 1A and 1B provided with a slide bearing between the ball joint and the coupling rod.

According to another embodiment, a plain bearing, in particular a radial plain or slide bearing, can be provided between the ball joint 11 and the coupling rod 2. The positional allocation of the coupling rod and the base plate in the axial direction is not tightly fixed. FIG. 1C shows a schematic representation of the slide bearing 40.

Figure 2A:
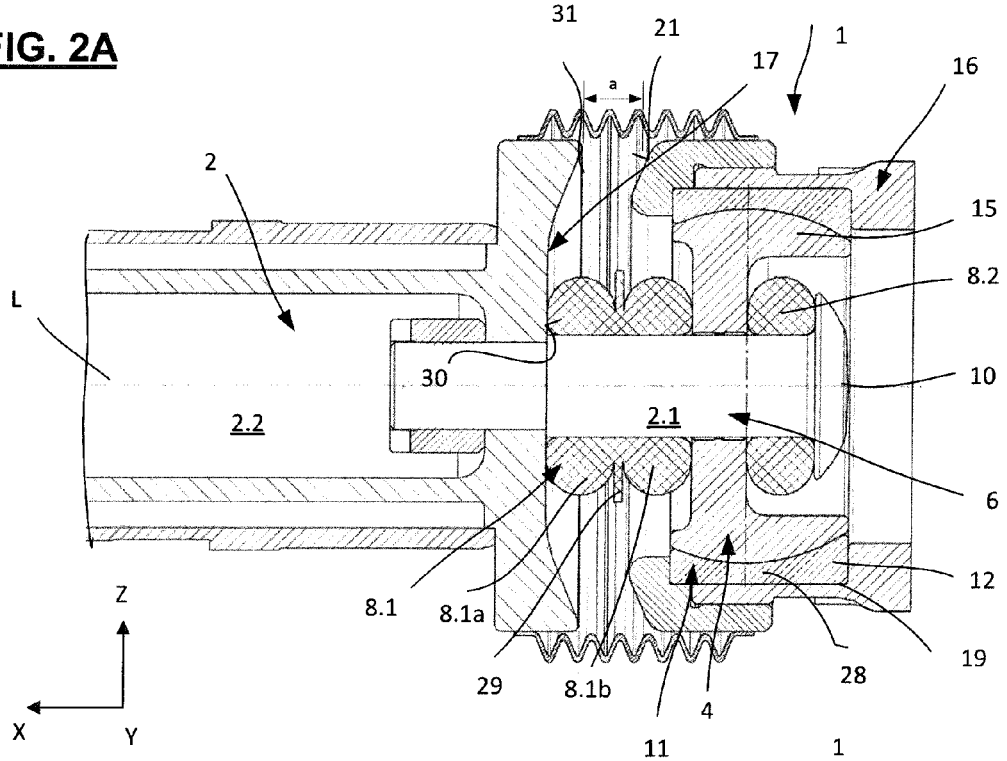
FIG. 2A shows a diagrammatically simplified schematic of an axial section of the basic construction of a linkage according to the invention in accordance with a second embodiment in the neutral position.

In comparison with the embodiment which is described in FIGS. 1A and 1B, FIG. 2A shows a particularly compact embodiment of a linkage 1 in accordance with a second embodiment in the neutral position, in which the mounting of the coupling rod 2, in particular of the railcar body-side end region 6, takes place directly via a ball and socket bearing 11 on the railcar body 3. In this case, the bearing block 16 is configured in such a way that it forms a first element 28 of a ball and socket bearing 11, whereas the base plate 4, which is connected to the coupling rod 2, in particular the base plate 4, which is connected to the railcar body-side end region 6 of the coupling rod 2, is configured as a second element 15 of the ball and socket bearing 11. In the embodiment shown, the first element 28 of the ball and socket bearing 11 is formed as a receiving device 28, a receiving element here, which is connected to the bearing block 16 in a stationary manner or is formed by the latter, whereas the second element 15 is formed by a base plate 4 which interacts with the receiving device 28 and forms the through opening 5 for receiving the coupling rod 2. The first element 26 (here, the bearing block 16) preferably forms the ball socket 12 with the spherically curved surface, whereas the base plate 4 or an element which is connected to it assumes the function of the ball joint 15. The remaining configuration and arrangement of the spring units 8.1, 8.2 provided for elastic support and the supporting plates 9, 10 takes place in an analogous manner to that described in FIGS. 1A and 1B. It is decisive that the function of the ball and socket bearing 11 is taken over directly here by the components of the base plate 4 and the bearing block 16.

In an analogous manner to that described in FIGS. 1A and 1B, the function of a vertical lift protective arrangement is ensured via surface regions 31 on the supporting plate 9 and 21 on the bearing block.

Figure 2B:
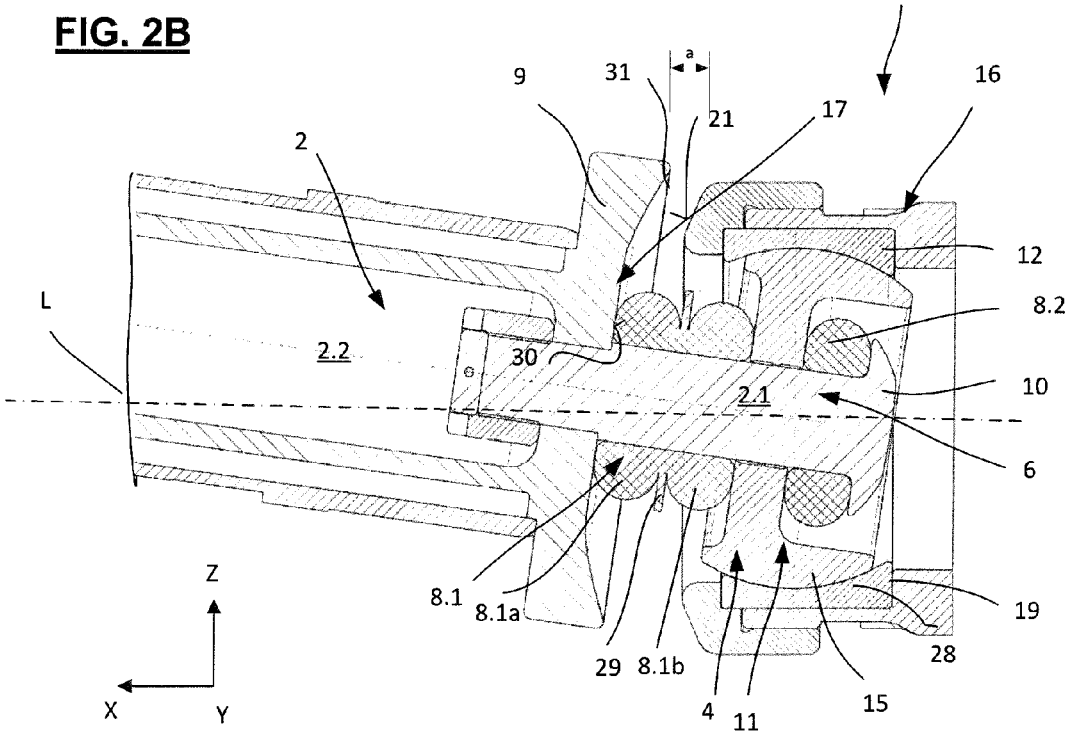
FIG. 2B shows an example of an axial section of the basic construction of a linkage according to the invention in accordance with a second embodiment in a deflected position.

FIG. 2B shows the embodiment according to FIG. 2A in the case of a deflection out of the neutral position.

In both embodiments, the bearing faces 21 are configured on the bearing block 16 and/or on the supporting plate 9 in such a way that, during the interaction, the supporting plate 9 enters into a positively locking and/or non-positive connection with the bearing block 16, in order to avoid vertical lifting of the coupling which is connected to the coupling rod 2. To this end, the surface regions 21 and 31 are preferably shaped in such a way that there is a stop in the vertical direction.

In the structural embodiments according to FIGS. 1B, 2A and 2B, the coupling rod 2 is of multiple piece configuration. The railcar body-side end region 6 is formed by a part element 2.1, on which the supporting plate 10 is preferably already configured integrally. A positively locking or non-positive connection between the part element 2.1 and the supporting plate 10 is also conceivable. The part element 2.1 is connected to a further part element 2.2 in a non-positive or positively locking manner. The supporting plate 9 is configured integrally with the part element 2.2 or else is connected to the latter fixedly so as to be driven by it, by way of a positively locking or non-positive or integrally joined connection. The part elements 2.1, 2.2 and possibly further part elements form the coupling rod 2.

In the case of both basic embodiments, it is optionally provided in one embodiment for the contact regions between the bearing block 16 or a component connected thereto and the corresponding supporting element 9 or 10 which is coupled to the coupling rod 2 not to be of rigid configuration, but rather of elastic configuration. Here, depending on the configuration of the end face regions on the supporting element 9, 10 and bearing block 16 which can be brought into operative connection with one another in the vertical lifting case, this can be a punctiform or linear or area-like contact region. For this purpose, at least one of the surface regions which come into operative connection with one another is provided, or else both surface regions are provided, with an elastic surface region. The latter can be configured integrally with the corresponding component or else can be formed by a separate element which is connected to the corresponding component (supporting element 9, 10 and/or bearing block 16), in particular an element which is connected to the respective end face.

Figure 3:
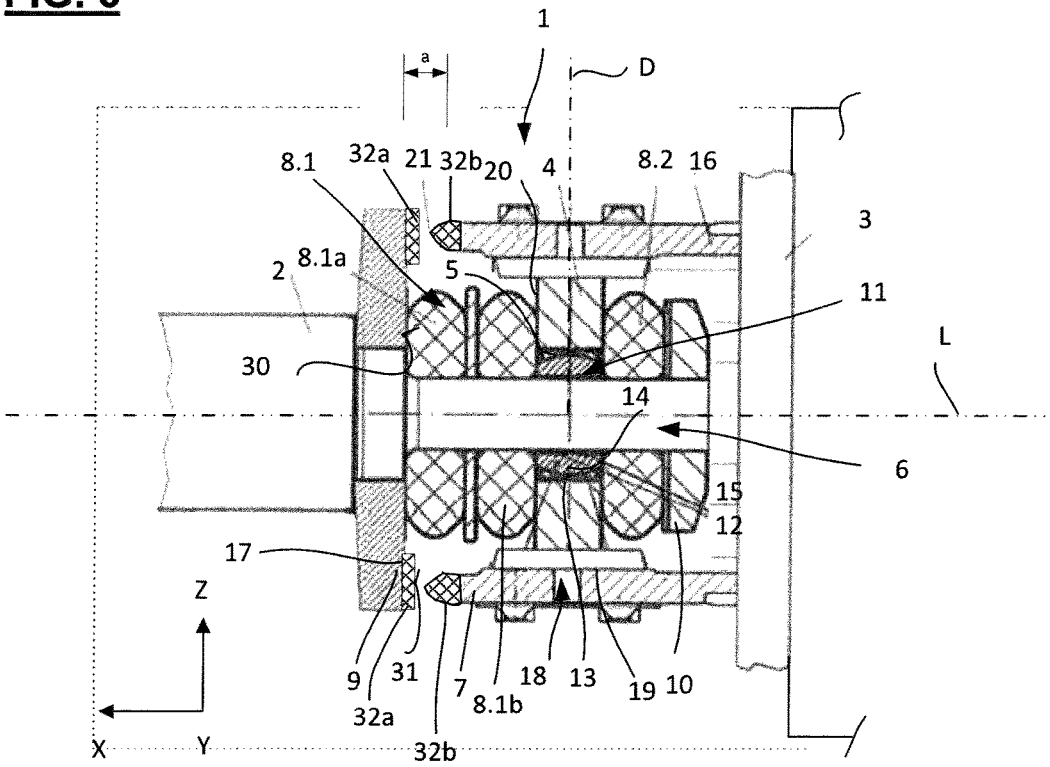
FIG. 3 shows a diagrammatically simplified schematic (using an embodiment according to FIG. 1A) by way of example of an elastic configuration of the contact regions between the bearing block and the supporting element; and, FIG. 4 shows a diagrammatically simplified schematic showing a plan view from above by way of example of a linkage of the coupling rod at an angle with respect to the longitudinal axis in a horizontal plane, with additional pivoting of the base plate.

FIG. 3 shows a simplified schematic by way of example of the elastic configuration of a surface region 31 on the supporting element 9, which surface region 31 can be brought into operative connection with the bearing block 16 in the vertical lifting case. The surface region 31 on the supporting element 9 is formed by a separate element in the form of a spring element 32*a*. As can be seen from FIG. 3, two spring elements 32*a* of this type are provided, which are arranged offset from one another in the vertical direction and, as viewed in the vertical direction, are arranged in each case in the regions of the end face 17 on the supporting element, which end faces 17 come to bear against the end face 21 of the bearing block in the case of a deflection with a direction component in the vertical direction as viewed toward the coupling longitudinal axis. The spring elements 32*a* are preferably configured as leaf springs. The movement capability of the coupling rod 2 in the longitudinal direction is additionally increased by way of the compression of the spring elements 32*a* in the longitudinal direction. A greater proportion of the longitudinal force is thus produced via the additional compression of the elastomer elements, and not at the actual contact point between the supporting element 9 and the bearing block 16. This leads to lower bending moments in the coupling rod 2, since the sum of the force vectors is at a smaller spacing from the center line of the coupling rod as viewed in the longitudinal direction.

FIG. 3 illustrates one possibility using the spring elements 32*a*. The arrangement (shown diagrammatically) of spring elements 32*b* on their own or additionally on the end face 21 of the bearing block 16 is also conceivable.

In addition to the configuration of the supporting regions as elastic regions of elastic elements, in particular spring elements 32*a*, 32*b*, there is also the possibility to configure the regions integrally on the supporting elements 9 or the bearing block 16.

Figure 4:
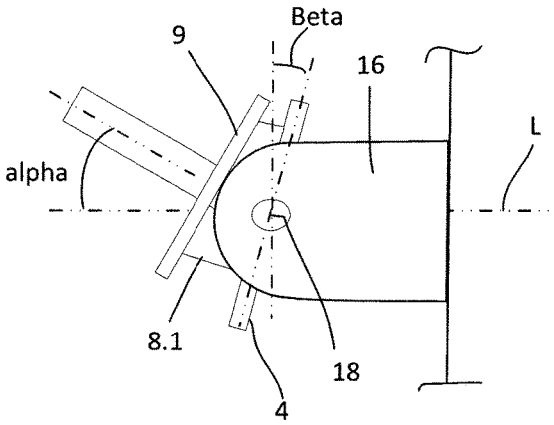

In a diagrammatic, simplified schematic in a plan view of the bearing block 16, FIG. 4 shows the increase in the deflection angle in the width direction, that is, as viewed in the horizontal plane, which can be achieved by way of the embodiment according to the invention with a base plate 4 which can be pivoted about the rotational axis D. The deflection of the coupling rod 2 via the spherical bearing 11 in the view onto the horizontal plane, that is, a plane which can be described by the longitudinal axis L and a perpendicular with respect thereto, oriented in the width direction, with respect to the longitudinal axis L is denoted by alpha. The pivoting capability of the base plate about the rotational axis D with respect to the neutral position can be described by the pivoting angle beta.

It is understood that the foregoing description is that of the preferred embodiments of the invention and that various changes and modifications may be made thereto without departing from the spirit and scope of the invention as defined in the appended claims.

LIST OF DESIGNATIONS

1 Linkage
2 Coupling rod
3 Railcar body
4 Base plate
5 Through opening
6 Railcar body-side end region
7 Pull/push device
8 Spring unit
8.1 First spring unit
8.2 Second spring unit
9 Supporting element
10 Supporting element (railcar body-side)
11 Spherical bearing; ball and socket bearing
12 Ball socket
13 Receiving device
14 Bearing face
15 Ball joint
16 Bearing block
17 End face on the supporting plate 9
18 Rotary joint
19 Opening in the bearing block
20 End face on the base plate
21 End face on the bearing block
22 Bush
23 Bearing cap
24 Fastening elements
25 Through opening, ball joint
26 First element
27 Second element
28 Receiving device
29 Intermediate element
30 Surface region on the supporting plate
31 Surface region on the supporting plate
32*a, b* Spring element
40 Slide bearing
a Spacing
L Longitudinal axis

What is claimed is:

1. A linkage for articulately connecting an end portion of a coupling rod to a railcar body of a rail-borne vehicle defining a longitudinal direction, said coupling rod defining a longitudinal axis and being movable between a neutral position wherein said longitudinal axis thereof is coincident with said longitudinal direction of said rail-borne vehicle and a deflected position, the linkage comprising:

a bearing block fixedly connectable to said railcar body;

a base plate coupled to said bearing block;

said base plate having a first side facing toward said railcar body and delimiting a first region extending toward said railcar body;

said base plate having a second side facing away from said railcar body and delimiting a second region extending away from said railcar body;

said base plate having a through opening formed therein for accommodating said end portion of said coupling rod extending therethrough and into said first region;

a push/pull assembly including a first support element arranged in said first region between said base plate and said railcar body; and, a second support element arranged in said second region facing toward said second side of said base plate;

said first side of said base plate and said first support element conjointly defining a first gap and said second side of said base plate and said second support element defining a second gap;

first and second spring units being disposed in said first and second gaps, respectively;

said base plate being mounted in said bearing block so as to be pivotable therein transversely to said longitudinal direction and in a horizontal plane; and, a spherical bearing for journaling said coupling rod in said through opening of said base plate.

2. The linkage of claim 1, wherein said spherical bearing is a ball and socket bearing.

3. The linkage of claim 2, wherein said through opening of said base plate has a peripheral region defining a ball socket of said ball and socket bearing with a spherical cap-like bearing face for a ball joint; and, the ball joint forms said through opening for receiving said end portion of said coupling rod.

4. The linkage of claim 3, further comprising an element form locked or force locked to said peripheral region and configured to define said ball socket.

5. The linkage of claim 3, further comprising a slide bearing arranged between said ball and socket bearing and said coupling rod.

6. The linkage of claim 3, wherein said coupling rod is form locked or force locked connected to said ball and socket bearing.

7. The linkage of claim 2, wherein said bearing block has two receiving openings defining respective center axes configured to run perpendicularly to said longitudinal axis of said coupling rod when said coupling rod is in said neutral position; and, said bearing block includes at least one rotary joint in one of said receiving openings; and, said base plate is rotatably journalled in said rotary joint.

8. The linkage of claim 2, wherein said bearing block has two receiving openings defining respective center axes configured to run perpendicular to said longitudinal axis of said coupling rod when said coupling rod is in said neutral position; said bearing block includes a bearing cap closing said receiving openings; and, said base plate is form locked or force locked connected to said bearing cap; and, said bearing cap is rotatably mounted in said receiving openings.

9. A linkage for articulately connecting an end portion of a coupling rod to a railcar body of a rail-borne vehicle defining a longitudinal direction, said coupling rod defining a longitudinal axis and being movable between a neutral position wherein said longitudinal axis thereof is coincident with said longitudinal direction of said rail-borne vehicle and a deflected position, the linkage comprising:

a bearing block fixedly connectable to said railcar body;

a base plate coupled to said bearing block;

said base plate having a first side facing toward said railcar body and delimiting a first region extending toward said railcar body;

said base plate having a second side facing away from said railcar body and delimiting a second region extending away from said railcar body;

said base plate having a through opening formed therein for accommodating said end portion of said coupling rod extending therethrough and into said first region;

a push/pull assembly including a first support element arranged in said first region between said base plate and said railcar body; and, a second support element arranged in said second region facing toward said second side of said base plate;

said first side of said base plate and said first support element conjointly defining a first gap and said second side of said base plate and said second support element defining a second gap;

first and second spring units being disposed in said first and second gaps, respectively;

said bearing block and said base plate conjointly defining a ball and socket bearing for pivotably supporting said coupling rod on said railcar body;

said ball and socket bearing conjointly defining a bearing interface whereat said base plate can rotate relative to said bearing block; and, said end portion of said coupling rod being accommodated and held in said through opening so as to pivot with said base plate as said base plate rotates relative to said bearing block.

10. The linkage of claim 9, wherein said bearing block is configured as a ball socket having a spherically curved bearing face.

11. The linkage of claim 10, wherein said base plate is configured as a ball joint having a spherically curved bearing surface formed as an outer peripheral surface thereof for coacting with said ball socket.

12. The linkage of claim 11, wherein said ball socket and said ball joint conjointly define an interface and said ball and socket bearing includes a socket element disposed at said interface and connected to said bearing block.

13. The linkage of claim 12, wherein said socket element is configured as a ball socket having a spherically curved bearing face.

14. The linkage of claim 13, wherein said base plate is configured as a ball joint having a spherically curved bearing surface formed as an outer peripheral surface thereof for coacting with said ball socket.

15. The linkage of claim 9, wherein said first spring unit includes a plurality of spring elements arranged in series with respect to each other; and, a plurality of intermediate elements disposed respectively between each two mutually adjacent ones of said spring elements.

16. A linkage for articulately connecting an end portion of a coupling rod to a railcar body of a rail-borne vehicle defining a longitudinal direction, said coupling rod defining a longitudinal axis and being movable between a neutral position wherein said longitudinal axis thereof is coincident with said longitudinal direction of said rail-borne vehicle and a deflected position, the linkage comprising:

a bearing block fixedly connectable to said railcar body;

a base plate coupled to said bearing block;

said base plate having a first side facing toward said railcar body and delimiting a first region extending toward said railcar body;

said base plate having a second side facing away from said railcar body and delimiting a second region extending away from said railcar body;

said base plate having a through opening formed therein for accommodating said end portion of said coupling rod extending therethrough and into said first region;

a push/pull assembly including a first support element arranged in said first region between said base plate and said railcar body; and, a second support element arranged in said second region facing toward said second side of said base plate;

said first side of said base plate and said first support element conjointly defining a first gap and said second side of said base plate and said second support element defining a second gap;

first and second spring units being disposed in said first and second gaps, respectively;

said bearing block and said base plate conjointly defining a ball and socket bearing for pivotably supporting said coupling rod on said railcar body;

said base plate being connected to said end portion of said coupling rod; and, wherein said bearing block has an end face facing toward said second support element; said end face includes a first bearing contact surface formed thereon; said second support element has a second bearing contact surface formed thereon; and, said first and second bearing contact surfaces conjointly define a predetermined distance therebetween when said coupling rod is in said neutral position and said first and second contact surfaces come into mutual contact engagement when said coupling rod is deflected out of said neutral position in a horizontal and/or vertical direction.

17. The linkage of claim 16, wherein said bearing contact surfaces are configured in such a way that in the case of an operative connection, they define a non-positive or positive locking connection.

18. The linkage of claim 16, wherein, as viewed in the installed position of the linkage, the bearing contact surfaces are configured so as to be curved transversely with respect to the longitudinal direction.

19. The linkage of claim 16, wherein the bearing contact surfaces on said second supporting element and/or the bearing block are of elastic configuration.

20. The linkage of claim 19, wherein the bearing contact surfaces are formed by a separate component configured as a spring element connected to the second supporting element and/or bearing block.

* * * * *